US007463001B2

(12) United States Patent
Tsurukawa

(10) Patent No.: US 7,463,001 B2
(45) Date of Patent: Dec. 9, 2008

(54) SOCCER AND FIGHTING ROBOT, AND DRIVING AND OPERATING DEVICE OF THE ROBOT

(75) Inventor: Fumiaki Tsurukawa, Kamoto-gun (JP)

(73) Assignee: Fumiaki Tsurukawa, Kamoto-gun (JP)

( * ) Notice: Subject to any disclaimer, the term of this patent is extended or adjusted under 35 U.S.C. 154(b) by 99 days.

(21) Appl. No.: 10/489,953

(22) PCT Filed: Sep. 24, 2002

(86) PCT No.: PCT/JP02/09794

§ 371 (c)(1),
(2), (4) Date: Oct. 1, 2004

(87) PCT Pub. No.: WO03/031008

PCT Pub. Date: Apr. 17, 2003

(65) Prior Publication Data

US 2005/0073276 A1 Apr. 7, 2005

(30) Foreign Application Priority Data

Sep. 21, 2001 (JP) ..... 2001-288266

(51) Int. Cl.
*B25J 5/00* (2006.01)

(52) U.S. Cl. ..... 318/568.12; 700/245; 901/1

(58) Field of Classification Search ..... 318/560–600; 700/1–245; 901/1
See application file for complete search history.

(56) References Cited

U.S. PATENT DOCUMENTS 4,573,548 A * 3/1986 Holland ..... 180/211
4,657,104 A * 4/1987 Holland ..... 180/211
5,182,557 A * 1/1993 Lang ..... 341/20
5,609,216 A * 3/1997 Fisher et al. ..... 180/24.03
5,647,554 A * 7/1997 Ikegami et al. ..... 242/390.9
5,857,334 A * 1/1999 Sekiguchi ..... 60/547.1
6,507,773 B2 * 1/2003 Parker et al. ..... 700/258
6,868,307 B2 * 3/2005 Song et al. ..... 700/245
6,896,078 B2 * 5/2005 Wakui ..... 180/7.1
7,013,200 B2 * 3/2006 Wakui ..... 700/245

FOREIGN PATENT DOCUMENTS

| | | |
|---|---|---|
| JP | 38-11543 | 6/1963 |
| JP | 50950 | 5/1974 |
| JP | 59-165265 | 11/1984 |
| JP | 60-109697 | 7/1985 |
| JP | 62-37309 | 3/1987 |
| JP | 62-74002 | 5/1987 |
| JP | 62-186783 | 11/1987 |
| JP | 5-134804 | 6/1993 |
| JP | 7-31559 | 6/1995 |
| JP | 8-54928 | 2/1996 |

(Continued)

*Primary Examiner*—Bentsu Ro
*Assistant Examiner*—David S Luo
(74) *Attorney, Agent, or Firm*—Westerman, Hattori, Daniels & Adrian, LLP.

(57) ABSTRACT

An amusement soccer and fighting robot, wherein a three-wheel drive cart usable as the drive device of various movable bodies is installed on a robot toy, whereby, since the robot can be moved freely by the use of the three wheel drive cart without relying upon a difficult walking operation, a soccer game and a fighting game can be realized by the robot with high game performance.

5 Claims, 4 Drawing Sheets

FOREIGN PATENT DOCUMENTS

| | | |
|---|---|---|
| JP | 9-75553 | 3/1997 |
| JP | 10-156051 | 6/1998 |
| JP | 10-254567 | 9/1998 |
| JP | 2000-262768 | 9/2000 |
| JP | 2002-222042 | 8/2002 |

* cited by examiner

SOCCER AND FIGHTING ROBOT, AND DRIVING AND OPERATING DEVICE OF THE ROBOT

FIELD OF THE INVENTION

The present invention relates to a soccer and fighting robot using a novel drive system, and an operating device therefor.

BACKGROUND OF THE INVENTION

The conventional drive device of a robot other than a walking type is in the form of a three or four-wheeled vehicle whose rotational axes are aligned in the same direction and as such cannot be used to reproduce the game of soccer performance because the drive device could not be made to move towards a ball laterally. In addition, the conventional drive device is not capable of changing its direction at a fast pace and is limited to chasing the ball, making it impossible to reproduce the game of soccer performance.

The object of the present invention is to reproduce the game of soccer performance by a robot by enabling it to swiftly move in any direction using a special three-wheel drive cart.

DISCLOSURE OF THE INVENTION

The robot of the present invention uses a special three-wheel drive cart designed to make it possible to move laterally. To operate the special three-wheel drive cart, a six directional joystick is installed for operation by the user/player to generate various actions by the robot, such as the kick action, the arm action, and the like.

BEST MODE FOR CARRYING OUT THE INVENTION

The embodiments of the present invention are hereafter described in relation to the drawings.

Figure 1:
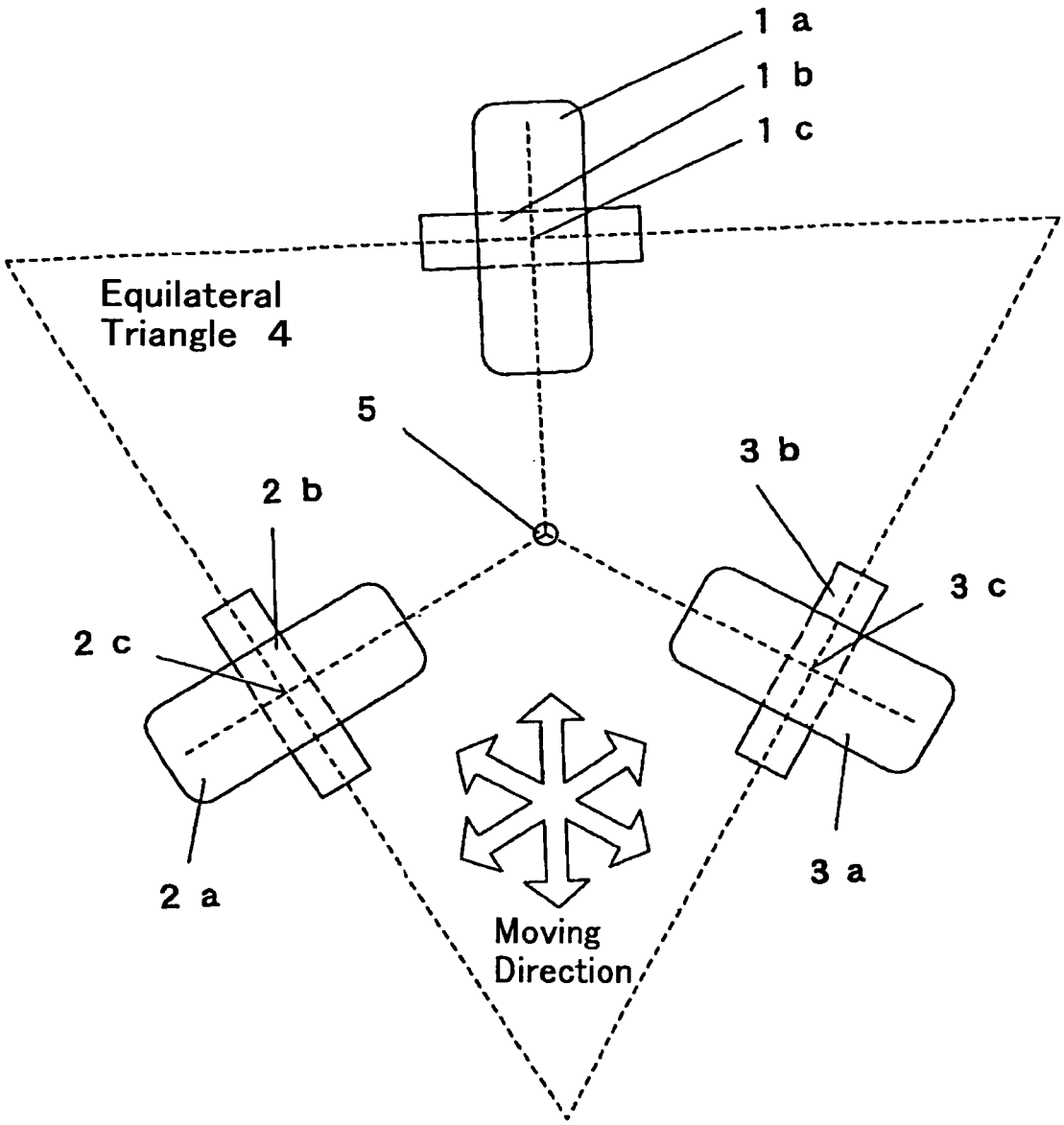
FIG. 1 is a conceptual top view of a three-wheel drive cart of Claim 1.

FIG. 1 is the conceptual top view of the three-wheel drive cart of Claim 1.

The rotational axes 1*b*, 2*b*, 3*b* of three wheels 1*a*, 2*a*, 3*a* are arranged so as to overlap the midpoints 1*c*, 2*c*, 3*c* of the three sides of an equilateral triangle 4, and each of which are capable of independently rotating forward and backward, enabling the cart to move in six directions, consisting of three original directions and their corresponding opposite directions, without changing the direction of the cart.

For example, viewed from the center 5 of the equilateral triangle 4 in FIG. 1, when the wheel 1*a* rotates outwardly and each of the wheels 2*a*, 3*a* rotates inwardly, the three-wheel drive cart having the wheels 1*a*, 2*a*, 3*a* as drive wheels moves in an upward direction.

Figure 2:
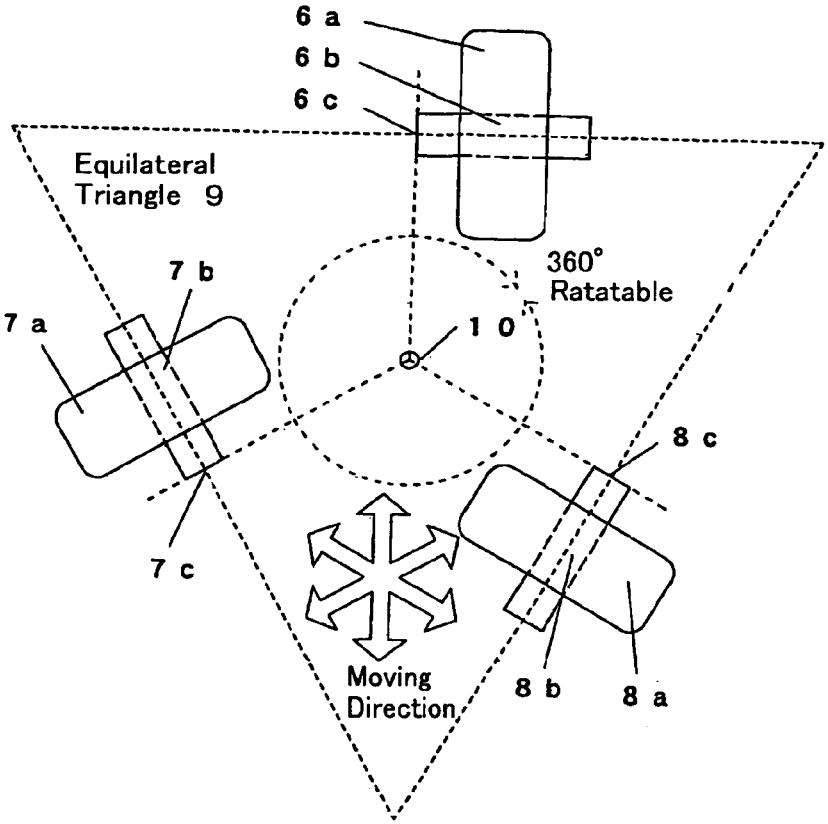
FIG. 2 is a conceptual top view of the three-wheel drive cart of Claim 1 whose axles are located off center.

FIG. 2 is the conceptual top view of the three-wheel drive cart of Claim 1 whose rotational axes 6*b*, 7*b*, 8*b* are located off-center from the midpoints 6*c*, 7*c*, 8*c* of the three sides of an equilateral triangle 9. This three-wheel drive chart has a special feature in that it can turn on the spot.

For example, viewed from the center 10 of the equilateral triangle 9 in FIG. 2, when each of the wheels 6*a*, 7*a*, 8*a* rotates outwardly, the three-wheel drive cart having the wheels 6*a*, 7*a*, 8*a* as drive wheels turns counterclockwise. Similarly, when the wheels rotate inwardly, the three-wheel drive cart turns clockwise.

Figure 3:
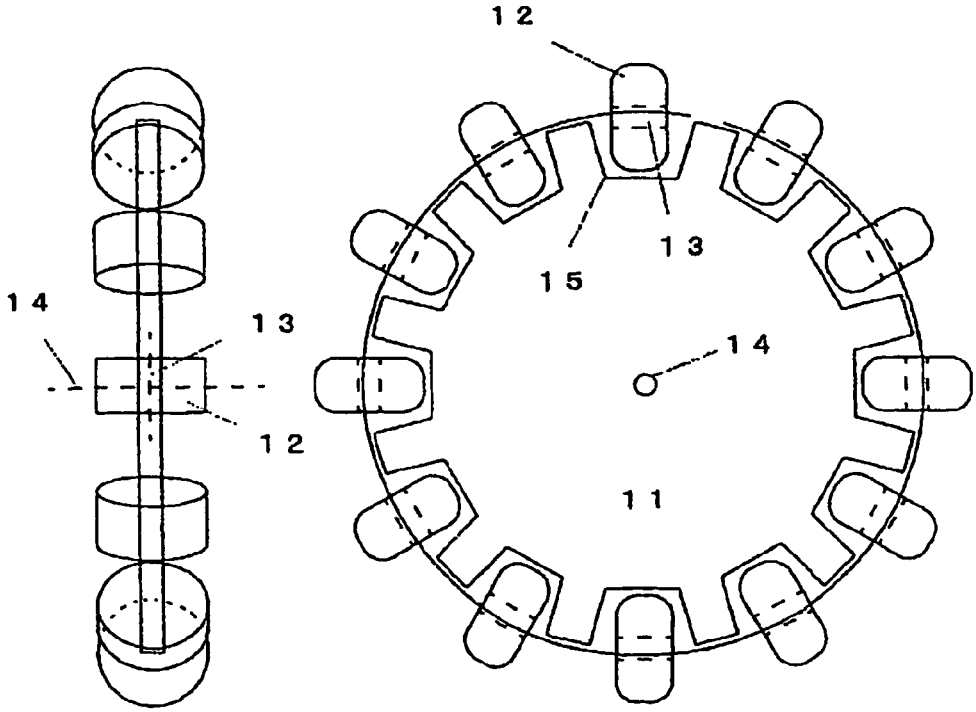
FIG. 3 illustrates the front and side views of the wheels of the three-wheel drive cart with rollers of Claim 1.

FIG. 3 is a conceptual view of a wheel 11 of Claim 1 when rollers 12 are installed on the ground plane thereof. The rotational axes 13 of the rollers 12 are installed in such manner as to solidly intersect with the rotational axis 14 of the wheel 11 at 90 degrees.

Figure 4:
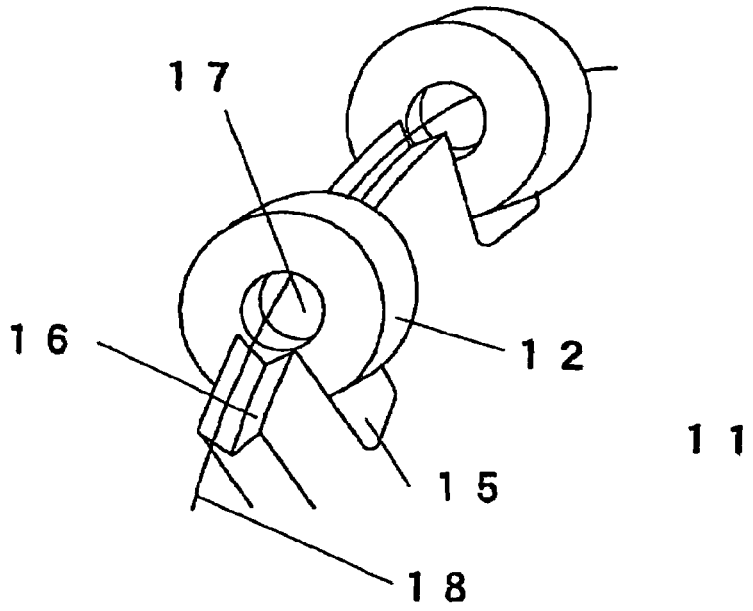
FIG. 4 is a view showing the method of manufacturing the wheels with rollers of Claim 2.

FIG. 4 is a view showing the method of installing the rollers 12 of Claim 2 to the wheel 11. Notches 15 are constituted to fit the rollers 12 into the disc-shaped wheel 11, while a groove 16 is formed on the uncut parts of the disc-shaped wheel along the rotational direction of the wheel 11, and a string 18, passing through holes 17 made at the rotational axes 13 of the rollers 12, is fitted and tied to the groove 16.

Alternatively, the notches 15 may be constituted on the pulley on which the groove 16 is originally formed to fit the rollers 12, and then the string 18, which is made to go through the holes 17 constituted on the rotational axes 13 of the rollers 12, is similarly fitted and tied.

Although the three-wheel drive cart will not move if rubber tires are used because they produce a large amount of lateral friction when they move, it has been noted that such friction will be suppressed if the lateral rollers 12 of Claim 1 are installed on the ground plane of the wheel, enabling it to move smoothly.

Figure 5:
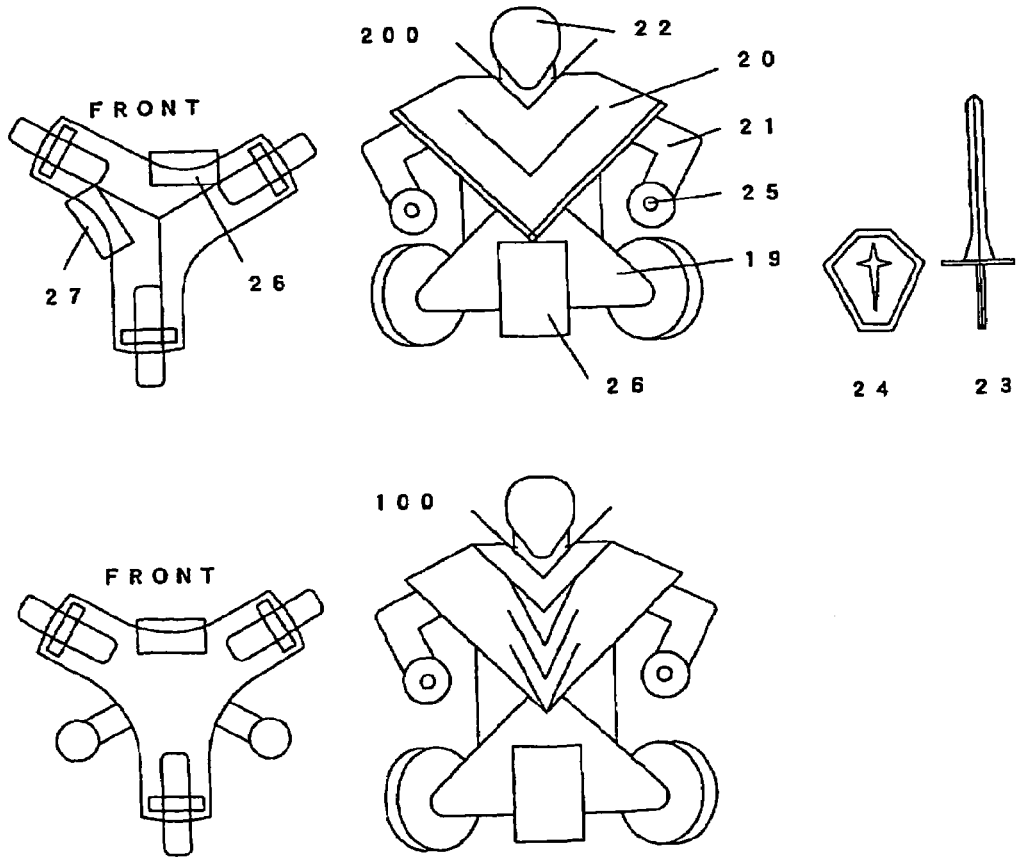
FIG. 5 is a conceptual view of soccer and fighting robots.

FIG. 5 presents conceptual views of the soccer and fighting robot using the features of the three-wheel drive cart described above. The robot 200 basically consists of a cart portion 19, a trunk portion 20, and an arm portion 21, with a hole 25 created in the area corresponding to the hand portion thereof, and a head portion 22, to which a sword 23 or a shield 25 is attachable.

A plate 26 for kicking the ball is disposed on the front part of the cart portion 19, which is capable of kicking the ball forward by remote control. A kick device 27 is also installed on one side of the cart portion 19, which can bring the ball to fly when made to operate because it is slightly bent upward. The use of such kick devices and their plates in appropriate situations enables the user/player to simulate passing and shooting movements as well as the free kick.

By remote control, the trunk portion of the soccer and fighting robot 200 can also be made to twist from left to right and vice versa as well, which command option is effective at the time of the robot's approach to an opponent robot or in the event its arms get entwined with those of an opponent or in the case where it is surrounded by the opponent.

Further, because the height of the robot may be adjusted based on the manner of installing the position of the trunk portion 20 and the arm portion 21, the user/player may, depending on the situation, choose between a type 100 which would have a wider space for catching the ball because of a higher though more unstable center of gravity and a type 200 which would have a smaller area for catching the ball compared to the taller robot because of a lower but more stable center of gravity.

Figure 6:
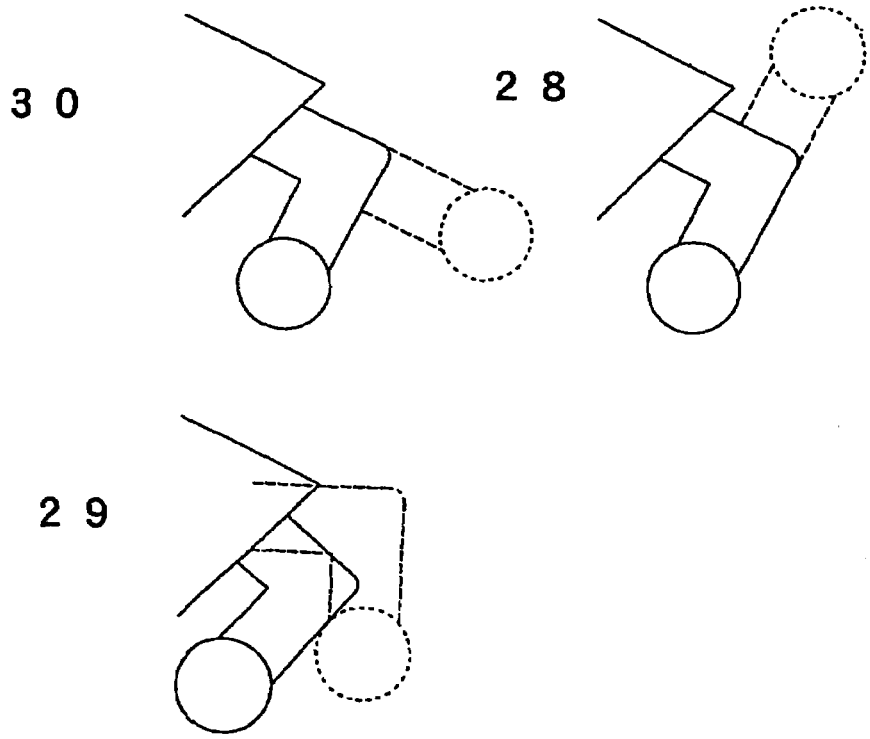
FIG. 6 is a conceptual view of the potential arm actions of a robot.

The user/player likewise has the option of setting the arm portion 21 and thereby select which action to adopt, such as the arm being swung up and down (and vice versa) 28, the arm being swung from left to right (and vice versa) 29, bringing the arm closer to the body 30 or stretching the elbow joint, as shown in FIG. 6. With these actions, the robot can make a feint to the opposing robot when scrambling for the ball or fight using either the sword 23 or the hand-held shield 24.

The replaceable head portion 22 of the robot can be substituted with a head portion with a flat face, upon which the user/player can affix his or her photograph sticker if desired.

Figure 7:
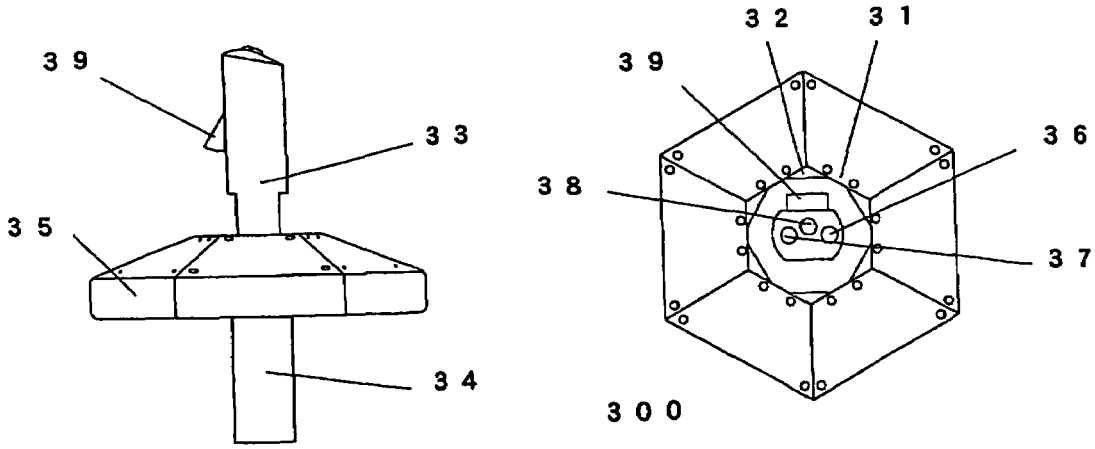
FIG. 7 illustrates the top and side views of the joystick used to operate the robots of Claims 3, 4 and 5.

FIG. 7 shows the device for operating the robot of Claims 3, 4 and 5. Since the number of directions in which the joystick can be tilted by means of a decorative plate 31 of Claim 3 is limited to six, operation thereof will depend on the decision of the user/player in accordance with the directional movements of the three-wheel cart of Claim 1.

For example, as shown in FIG. 7, when the operator tilts an operation lever 33 of the operating device 300 in an upward direction to press down a directional switch 32, a control signal is activated such that the wheel 1*a* of FIG. 1 rotates outwardly and the wheels 2*a*, 3*a* rotate inwardly. At this point, the cart having the wheels 1*a*, 2*a*, 3*a* as drive wheels moves in an upward direction as shown in FIG. 1.

It is assumed that the user/player will employ the operating device 300 in a standing position, and in this connection, the manner of holding the sword in Japanese fencing was taken in consideration, in which the user/player holds a bamboo sword by setting his right hand and left hand vertically. Accordingly, the device is constructed as to enable the user/player to hold the upper operation lever 33 with his right hand, and the lower handle 34 with his left hand if he/she is right-handed such that the tilting of the operation lever forward and backward would yield the corresponding forward or backward directional movement desired. In other words, if the user/player tilts the operation lever forward, the forward directional movement desired is reproduced and similarly, if he tilts it backward, the backward directional movement desired is simulated. This was achieved by disposing the lower handle 34 beneath the pedestal 35 of Claim 5.

Various switches have also been provided for the operation lever 33 such that the user/player can press a right-turn switch 36, a left-turn switch 37, or an arm action switch 38 with his thumb as described in Claim 5. Similarly, a kick switch 39 is provided on the side opposing the user/player employing the operation lever such that he can press it with his index finger.

INDUSTRIAL APPLICABILITY

Accordingly, a soccer game or a fighting game can be simulated with the use of robots capable of versatile performance because it is possible to operate them freely with the use of the novel three-wheel drive cart described above.

What is claimed is:

1. A three-wheel cart, wherein the rotational axis of each of the three drive wheels of the three-wheel drive cart is arranged to overlap the three sides of an equilateral triangle, and multiple grooves are formed parallel to the rotational axis of said drive wheels on the ground plane of the wheel and rollers are installed on said multiple grooves respectively so as to rotate in a direction of intersecting with the rotational axis of the wheel at 90 degrees.

2. A method of installing the rollers on the ground plane of the wheel of said three-wheel drive cart of claim 1, wherein the rollers are affixed to the groove by a line-shaped object, which is allowed to go through the holes of the rotational axes of the rollers.

3. A robot, comprising the cart of claim 1 as a drive portion, and a joystick-type operating device to which a decorative plate having a hexagonal hole is made to limit the tilting directions of an operation lever in six directions with an interval of 60 degrees.

4. A robot, comprising the cart of claim 1 as a drive portion, and a joystick-type operating device provided with a handle so as to be coaxial with an operation lever beneath the pedestal of the joystick or in such manner as to contact the operation lever using the pedestal as a base point.

5. A robot, comprising the cart of claim 1 as a drive portion, and a joystick-type operating device in which an operation lever includes one or more of switches of a right-turn switch, a left-turn switch, a kick switch, an arm portion operation switch, and the like.

* * * * *